US006871595B1

(12) United States Patent
Lewis

(10) Patent No.: US 6,871,595 B1
(45) Date of Patent: Mar. 29, 2005

(54) DISSEMINATION OF ODORANTS IN COMBINATION WITH AUDIOVISUAL MESSAGES TO MODIFY BEHAVIOR

(75) Inventor: Jean Marie Lewis, Manassas, VA (US)

(73) Assignee: Jean Lewis, Manassas, VA (US)

( * ) Notice: Subject to any disclaimer, the term of this patent is extended or adjusted under 35 U.S.C. 154(b) by 0 days.

(21) Appl. No.: 10/408,810

(22) Filed: Apr. 7, 2003

(51) Int. Cl.[7] ..... F42B 12/36

(52) U.S. Cl. ..... 102/502; 102/293; 102/367; 424/84

(58) Field of Search ..... 102/501, 502, 102/512, 293, 367–370; 43/1; 424/84, 43–45; 119/602–604, 712, 718, 174, 860

(56) References Cited

U.S. PATENT DOCUMENTS 4,392,432 A * 7/1983 Fenrick et al. ..... 102/334
4,582,492 A * 4/1986 Etter et al. ..... 434/236
4,667,601 A * 5/1987 Diamond et al. ..... 102/368
4,893,615 A * 1/1990 Khabirova ..... 601/16
5,904,916 A * 5/1999 Hirsch ..... 424/45
5,999,105 A * 12/1999 Gordon ..... 340/5.9
6,041,737 A * 3/2000 Hennigan ..... 119/165
6,242,489 B1 * 6/2001 Pinney ..... 514/562
6,273,027 B1 * 8/2001 Watson et al. ..... 119/712
6,282,458 B1 * 8/2001 Murayama et al. ..... 700/239
6,352,032 B1 * 3/2002 Pinney ..... 102/367
6,386,113 B1 * 5/2002 Pinney ..... 102/367
6,484,062 B1 * 11/2002 Kim ..... 700/90
6,683,044 B1 * 1/2004 Arienzo ..... 512/5
2002/0081341 A1 * 6/2002 Sott ..... 424/725
2002/0135739 A1 * 9/2002 Standard et al. ..... 353/46
2003/0054049 A1 * 3/2003 Shoji et al. ..... 424/733
2004/0064995 A1 * 4/2004 Gilmore ..... 43/1

FOREIGN PATENT DOCUMENTS

GB 2 345 635 A * 7/2000

* cited by examiner

*Primary Examiner*—Michael J. Carone
*Assistant Examiner*—James S. Bergin

(57) ABSTRACT

This invention describes a method to psychologically alter the mental state of a target individual or audience by introducing odors to illicit memory in combination with a robust, coordinated audiovisual scheme, which results in the susceptibility to change their behavior. The odorant compositions are formed from ingredients comprised of at least an odorant compound and a carrier liquid. Preferred odorant compounds include a variety of familiar odors which provide the olfactory stimuli required to be effective. Non-lethal dissemination systems to deliver the odorant to the target individual or group are also described.

1 Claim, No Drawings

DISSEMINATION OF ODORANTS IN COMBINATION WITH AUDIOVISUAL MESSAGES TO MODIFY BEHAVIOR

CROSS-REFERENCE TO RELATED APPLICATIONS

U.S. Pat. No. 5,904,916
U.S. Pat. No. 6,352,032
U.S. Pat. No. 6,386,113

FIELD OF THE INVENTION

This invention describes odorant compositions, their dissemination methods and devices that employ them.

BRIEF DESCRIPTION OF THE SEVERAL VIEWS OF THE DRAWING

Not applicable

STATEMENT REGARDING FEDERALLY SPONSORED RESEARCH OR DEVELOPMENT

Not Applicable.

REFERENCE TO SEQUENCE LISTING A TABLE OR A COMPUTER PROGRAM LISTING COMPACT DISK APPENDIX

Not Applicable.

DRAWINGS

Not applicable

BACKGROUND OF THE INVENTION

Nonlethal weapons are gaining popularity as options to elicit a desired behavior or action in modern military warfare, law enforcement and crowd control. As an example, military methods employing psychological operations that include dissemination of leaflets, handbills, posters, TV, loudspeaker broadcasts, radio, etc, have been considered one of the primary force multipliers in modern warfare that achieve enemy surrenders, clear main supply/transportation avenues, disperse crowds or provide information. While psychological operations are generally limited to an opposing force, it can be also used to achieve higher morale, focus, and aptitude in teams, groups, or students. As identified in U.S. Pat. No. 5,904,916; by administering a mixed-floral odorant to an individual or group, their ability to learn a new task, perform analysis, and general concentration was enhanced. While memory of the odorant was not the mechanism portrayed in the patent, other memory-recall odorants have the potential to change behavior, particularly if complemented with a coordinated audio-visual scheme.

It is well known that various odorants can elicit potent psychological and physiological responses. The olfactory nerve is the primary location responsible for recognition and perception of odors. Additionally, memory and life experiences that identify with the odorant have the potential to cause someone to change their behavior or mental state.

Based on the capacity to modify behavior with odorants, only malodorants have been considered as potential nonlethal weapons. This is exemplified in U.S. Pat. No. 6,352,032 and U.S. Pat. No. 6,386,113, which describes the exclusive use of stenches to bring about a desired behavior, there is a fundamental need for non-repulsive odorant compositions and their dissemination means. Additionally, these odorants must have no permanent negative or harmful impact on the target individual, audience, or the environment after dissemination of the odorant.

BRIEF SUMMARY OF THE INVENTION

Odorant compositions used alone or in combination with other psychological audiovisual applications can increase the likelihood of achieving success in a desired operation. The present invention has application in a variety of settings, including, but not limited to its use as a non-lethal military force multiplier, general group attitude and behavior modifier, and in security and law enforcement assistance such as preemptive crowd control or mob prevention. While experiencing certain odor compositions, a variety of responses can be observed via direct correlation with memories experienced. Physiological and psychological responses that occur once someone experiences the odorants include reactions such as hunger, grief, pleasure or excitement. Odorants can also be used with robust psychological messages to increase aptitude and ability in sports, to achieve resolve in stressful situations that require alertness and concentration, and other applications where a group or individual's mental state can be made susceptible to influence.

The odorant compositions of this invention are formulated and delivered under conditions effective to be received by the olfactory nerve located within the nose. The odorant compositions of this invention may be used alone, or employed in combination with other situational tools, such as information broadcasts, paper dissemination means and with audio sounds to enhance the situational impact.

In one embodiment of the present invention, an odorant formulation is comprised of at least one odorant compound and a carrier liquid, wherein the composition so formed has a toxicity category rating of at least III. Other additive materials that may make up the odorant formulation include odor intensifiers, preservatives, dyes, anti-foaming agents, enhances, anti-static agents, etc. As used in this specification, "toxicity category rating" means each of dermal irritation, inhalation, dermal sensitization, and eye irritation toxicity category ratings as determined under Proposed Rule, 49 Federal Register 188, in which ratings range from I to IV and None, with I being the most toxic and None being the least. Thus, for example, a composition of this invention has a toxicity category rating of at least In if each of the aforementioned ratings determined in accordance with 49 Federal Register 188 is III or higher. The odorant compound is formed from a single or multiple compounds and is generally dissolved, diluted or dispersed in the carrier liquid to form the odorant composition.

The method comprises exposing the individual (s) to an odorant formulation, as described by placing the individuals (s) in contact with, or in sufficient proximity with, the odorant composition such that the individual(s) may detect the composition's odor. The odorant formulation of this invention may be packaged or contained in a vessel to allow them to be directed or delivered to an intended target area using any one of a multitude of delivery techniques. In yet another aspect of this invention, a non-lethal weapon system is provided which comprises a projectable housing containing an odorant formulation, and wherein the housing may rupture, break, or detonate upon impact.

DETAILED DESCRIPTION OF THE INVENTION

The odorant formulation of this invention may be produced by various processes and temperatures and pressures which enable the efficient handling of ingredients and depending upon the application in which the odorant formulation will be employed. While specific formula modifications will be required for certain dissemination scenarios, these changes would be a routine undertaking for those of ordinary skill in the art having the benefit of this disclosure.

In accordance with the present invention, the odorant formulations are made from ingredients comprising at least two different compounds; at least one odorant compound and a carrier fluid. Depending on the application and dissemination device used, other additives may be used, such as an odor intensifier. In all cases the composition of this invention so formed must have a toxicity category rating of at least III. This invention is susceptible to considerable variation in its practice. Thus, the odorant formulation description is not limited to the particular exemplification.

The odorant component of the odorant formulation may be comprised of a variety of ingredients that comprise odors that initiate memory recall. Odorant formulations can be obtained as essential oils from natural substances or synthesized via methods in synthetic chemistry. The concentration of the odorant compound or compounds in the odorant formulations of the invention may vary depending on the particular odorant employed and on the application for which the odorant formulation is intended. The odorant compound should have sufficient characteristics to be effective under the circumstances of intended use.

The intensity and lasting effect of the odorant may be controlled by the concentration of odor intensifier present in the odorant formulation. The odor intensifier and the concentration thereof should chosen such that the odorant composition formed has a toxicity category rating of at least III. Skatole is an indole commonly used in perfumes at very low concentrations for its odor-intensifying properties. The term 'skatole' typically refers to the compound 3- methyl indole. While the concentration of odor intensifier may vary for a given application, it will preferably in the range of about 0.05 wt. % to about 5 wt. %, of the odorant formulation.

The odorant compound may be dissolved, diluted, or otherwise dispersed, in a carrier liquid which may be an aqueous, organic, and/or oil-based carrier or diluent liquid. This carrier liquid may be comprised of any one or more of a variety of compounds, and its selection may vary depending on the particular odorant compound used and on the application for which the odorant composition is intended. Examples of suitable diluents may include water or water-based solutions and buffers, organic solvents (e.g., esters, ethers, ketones, nitriles, hydrocarbons, etc.), and oleaginous liquids, both natural and synthetic, including mixtures. Preferably, the carrier liquid is one which effectively produces a volatility optimum for dissemination as compared to the composition which is substantially devoid of the carrier liquid. In one embodiment, a plant oil is used to improve physical characteristics such as, e.g., improve viscosity, lower volatility, etc., and to facilitate storage and/or transportation of the odorant formulation. In any event, the composition which includes the carrier liquid should always have a toxicity category rating of at least III.

Depending on the particular application and/or method for delivering the odorant composition to its intended target area, it may be desirable to include other chemical components in the compositions. These may include preservatives, such as ethylene diamine tetraacetic acid (EDTA), marking dyes (e.g., permanent, non-permanent, fluorescent, or iridescent dyes, etc.), viscosity modifiers, bismuth and other like compounds for enhancing ballistic properties, anti-foaming agents, anti-static agents, and the like, including mixtures of any two or more of the foregoing.

It is found that the odorant compositions of this invention deliver a stimulus that is perceived by the olfactory nerve. The response is typically characterized by a strong desire to obey the message delivered in conjunction with the odorant and accompanying audiovisual message. Persons exposed to the odors, particularly those with vivid memories, or lowered mental state due to hunger, fatigue, etc, will be more susceptible to be effected by the odors.

By selection of an appropriate delivery means, it is envisioned that the odorant compositions will be beneficial in a wide range of applications, e.g., for peaceful dispersion of unruly crowds or mobs, for incapacitation of instigators or other key personnel, for denial and or discouragement of access to specific areas, for peaceful clearing of personnel from structures and facilities, for control of movement of crowds, for neutralization of vehicles, aircraft, vessels, and facilities, as an adjutant in hostage negotiations, an alternative to anti-personnel land mines, as a first line warning device to civilian personnel not to enter an area, and other like scenarios. Positive crowd control can be experienced in situations such as gaining momentum with a battle-fatiqued fighting force, gaining inspiration in a team environment, and subliminal messages to perform a desired task such as spending money, assisting others, making peace, or other circumstantial attitude adjustments.

In accordance with this invention, in order to effect memory recall in one or more individuals to modify their behavior, the individual(s) are exposed to a odorant composition of this invention. The odorant compositions of the present invention may be packaged or otherwise contained in a vessel to allow them to be directed or delivered to an intended target area using any one of a multitude of delivery techniques. Thus, the present invention also provides a device which comprises a containment vessel for storing a liquid material, and within the vessel a liquid material comprised of a odorant composition formed from ingredients comprising (i) at least one odorant compound and (ii) a carrier liquid, wherein the odorant composition so formed has a toxicity category rating of at least III.

DETAILS—EXAMPLES

The following examples are provided to demonstrate various embodiments of this invention. It should be appreciated by those skilled in the art that the techniques disclosed in the examples which follow represent those found by the inventors to function in the practice of the invention. However, those skilled in the art should, in light of the present disclosure, appreciate that many changes can be made in the specific embodiments which are disclosed herein and still obtain a like or similar result without departing from the spirit and scope of the invention.

Example 1

In example 1, the intent of the odorant in combination with the audiovisual scheme is to invoke hunger, or perception of hunger in a target group. In conjunction with the odorant formulation of certain familiar food odors, such as the odor of grilling steak, frying chicken, popcorn, or the like, an audiovisual message is produced that may contain accompanying sounds that simulate the frying process or the eating process. The resultant effect is to initiate a salivatory gland response, which makes the target individual (s) susceptible to a secondary behavioral request, such as moving to another location.

The following odorant composition was prepared at ambient temperature without the manipulation of temperature, under ambient atmosphere and at atmospheric pressure, according to the following formulation:

| | |
|---|---|
| synthetic popcorn odor | 750 ml |
| 3-methylindole | 10 ml |
| cottonseed | 200 ml |

TABLE 1

Matrix of potential odorants, audiovisual inputs, and likely physiological or psychological response.

| ODORANT | AUDIOVISUAL INPUT | PHYSIOLOGICAL RESPONSE |
|---|---|---|
| Medicinal | movement locations | awareness, focus |
| foods (odors of frying steak, chicken, bread baking) | surrender appeals, meal locations | hunger |
| crayons, floral scent | sounds of children; baby crying surrender appeals | loneliness, sadness |
| chlorine-like | water dripping, ocean sounds, information on locations of water | thirst |
| cherries | yawns, lullabies surrender appeals | sleepiness |
| pine, bayberry | Christmas carols | homesickness |
| phereomones | seductive appeals | arousal, lust |

OTHER REFERENCES

Witten et al., "Malodorous Substances as Riot Control and Troop Training Agents", Edgewood Arsenal Technical Report EATR 4370, March 1970, 30 pages.

Coppernoll, Margaret-Anne, "Ethical and Legal Principles Concerning The Use of Non-Lethal Weapons", National Security Affairs Website <http://nsa.nps.navy.mil/publications/micewski/coppernall.htm> (visited Dec. 5, 2000) unknown publication date, 18 pages.

Lewer, Nick et al.; "Non-Lethal Weapons: A Fatal Attraction?"; Zed Books Ltd., 1997; p. 13.

Siniscalchi, Joseph; "Non-Lethal Technologies: Implications For Military Strategy"; Air War College Website <http://www.au.af.mil/au/database/research/ay 1997/awc/97-177.htm> (visited Dec. 5, 2000) unknown publication date, internal date April 1997; 75 pages.

Hirsch, Alan R., USP 5, 904, 916; May 18, 1999. 'Use of Odorants to alter learning capacity'.

J. R. King, "Anxiety Reduction Using Fragrances," in The Psychology and Biology of Fragrance, pp. 147–165, Van Toller & Dodd (eds.) Chapman and Hall, Ltd, London (1988).

A. R Hirsch, 'Enhancement of Learning with a Floral Odor', APA Annual Meeting Philadelphia, Pa., May 21–26, 1994, AbstractNo. NR 655, p227.

A. R. Hirsch and L. H. Johnson, 'Odors and Learning', The 17$^{th}$ Annual Meeting of the American Academy of Neurological and Orthopaedic Medicine and Surgery, Las Vegas, Nevada Sep. 11, 1993, 35 pp.

What I claim as my invention is:

1. A non-lethal weapon dissemination system for crowd or mob control comprising:

a non-repulsive odorant comprising a memory eliciting substance capable of initiating memory recall to motivate a desired behavior in at least one targeted individual;

a dissemination device comprising a projectable housing to disperse the odorant;

a message device capable of delivering an audiovisual message;

wherein the audiovisual message is employed in combination with the dispersed odorant to elicit the desired behavior in the crowd or mob.

* * * * *